US012349824B2

(12) United States Patent
Hubbard

(10) Patent No.: US 12,349,824 B2
(45) Date of Patent: Jul. 8, 2025

(54) SPLIT BEDSHEET COVERING

(71) Applicant: Audrey Hubbard, Brooklyn, NY (US)

(72) Inventor: Audrey Hubbard, Brooklyn, NY (US)

( * ) Notice: Subject to any disclaimer, the term of this patent is extended or adjusted under 35 U.S.C. 154(b) by 257 days.

(21) Appl. No.: 17/689,655

(22) Filed: Mar. 8, 2022

(65) Prior Publication Data

US 2022/0346573 A1 Nov. 3, 2022

Related U.S. Application Data

(60) Provisional application No. 63/181,548, filed on Apr. 29, 2021.

(51) Int. Cl.
*A47G 9/02* (2006.01)
*A47G 9/00* (2006.01)

(52) U.S. Cl.
CPC ..... *A47G 9/0238* (2013.01); *A47G 9/0223* (2013.01); *A47G 2009/004* (2013.01)

(58) Field of Classification Search
CPC ..... A47G 9/02; A47G 9/0207; A47G 9/0223; A47G 9/023; A47G 9/0238; A47G 2009/004
See application file for complete search history.

(56) References Cited

U.S. PATENT DOCUMENTS 5,887,299 A * 3/1999 Phillips ..... A47G 9/086 5/413 R
6,226,814 B1 * 5/2001 Alexander ..... A47G 9/023 5/923
6,237,171 B1 * 5/2001 Allen ..... A47G 9/023 5/500
6,311,347 B1 * 11/2001 Limardi ..... A47G 9/0223 5/482
7,100,223 B1 * 9/2006 Anthony ..... A47G 9/0238 5/482
8,214,947 B1 * 7/2012 Helton ..... A47G 9/023 5/482
9,924,812 B1 * 3/2018 Kennedy ..... A47G 9/02
10,154,743 B1 * 12/2018 Ferguson ..... A47G 9/0223
10,881,225 B1 * 1/2021 Bernick ..... A47G 9/0207
2006/0031987 A1 * 2/2006 Stanfield ..... A47G 9/0207 5/486
2008/0313809 A1 * 12/2008 Inman ..... A47G 9/023 5/486
2009/0126111 A1 * 5/2009 Maimone ..... A47G 9/0261 5/485
2009/0199336 A1 * 8/2009 Gentile ..... A47G 9/023 5/486
2009/0249547 A1 * 10/2009 Lee ..... A47G 9/0207 5/482

(Continued)

*Primary Examiner* — George Sun
(74) *Attorney, Agent, or Firm* — Brennan, Manna & Diamond, LLC

(57) ABSTRACT

The present invention relates to a split bedsheet covering. The covering is used by two users, while sleeping and features a central split along a central longitudinal axis of the bedsheet. The central split provides two symmetrical portions for two users to utilize independently while still sleeping with their feet covered as the length of the split is less than the total length of the bedsheet. The covering is substantially rectangular or square, and can be applied to a mattress. The split is created by detaching two split edges wherein each split edge has a magnetic strip and padding.

14 Claims, 5 Drawing Sheets

(56) References Cited

U.S. PATENT DOCUMENTS

| | | | | |
|---|---|---|---|---|
| 2009/0297798 | A1* | 12/2009 | Tsai | A47G 9/086 5/413 R |
| 2011/0252563 | A1* | 10/2011 | Horstman | A47G 9/0207 5/486 |
| 2011/0289686 | A1* | 12/2011 | Chose | A47G 9/0207 5/497 |
| 2013/0014326 | A1* | 1/2013 | Kane | A47G 9/02 156/227 |
| 2013/0191991 | A1* | 8/2013 | Graddy | A47G 9/023 5/502 |
| 2013/0260076 | A1* | 10/2013 | Hejazifar | A47G 9/0253 5/490 |
| 2014/0189952 | A1* | 7/2014 | Crispino | A47G 9/02 112/475.08 |
| 2014/0352062 | A1* | 12/2014 | Messina | A47G 9/023 5/495 |
| 2016/0135622 | A1* | 5/2016 | Zhou | A47G 9/0223 5/413 R |
| 2017/0238734 | A1* | 8/2017 | Pastor | A47G 9/083 |
| 2017/0311730 | A1* | 11/2017 | Alletto | A47G 9/0238 |
| 2019/0021525 | A1* | 1/2019 | Hamm | B32B 7/08 |
| 2020/0146474 | A1* | 5/2020 | Reid | A47G 9/0207 |
| 2020/0238045 | A1* | 7/2020 | Pacheco | A61M 21/02 |
| 2020/0385893 | A1* | 12/2020 | Trovi | D06C 7/00 |
| 2021/0244207 | A1* | 8/2021 | Martinez | A47G 9/023 |

* cited by examiner

SPLIT BEDSHEET COVERING

CROSS-REFERENCE TO RELATED APPLICATION

The present application claims priority to, and the benefit of U.S. Provisional Application No. 63/181,548, which was filed on Apr. 29, 2021 and is incorporated herein by reference in its entirety.

FIELD OF THE INVENTION

The present invention relates generally to the field of bedsheets. More specifically, the present invention relates to an improved bedsheet covering that has two independent symmetrical portions enabling two users or sleeping partners to independently use one portion during sleep. Specifically, the improved bedsheet covering features a central longitudinal split that provides two symmetrical half portions for two sleeping partners. Accordingly, this disclosure makes specific reference thereto the present invention. Nonetheless, it is to be appreciated that aspects of the present invention are also equally applicable to other like applications, devices and methods of manufacture.

BACKGROUND OF THE INVENTION

By way of background, it is often difficult to share a single blanket, quilt, comforter or even bedsheet (collectively referred to as sheets) between two people. Each user may have different preferences as to how they want to use the sheets while sleeping, (i.e., whether the user wants to be fully or partially covered with the sheets, etc.). Due to these preferences, users tend to constantly adjust sheets and blankets which can lead to restlessness, inadequate sleep and even fights.

Further, utilizing separate sheets may not be advantageous, as users may feel a lack of intimacy or closeness during sleep. In many cases, users utilize a bedsheet to cover themselves at night and in such cases, a single bedsheet may not be adequate for users as they may end up elbowing and jostling each other through the night. Additionally, users do not get the desired coverage required with one bedsheet, which may lead to disturbing other users throughout the night. Accordingly, a sheet is needed that can be used independently and simultaneously by two users.

Therefore, there exists a long felt need in the art for a modified sheet that allows users to maintain a desired coverage throughout the night or any duration when they sleep. There is also a long felt need in the art for a modified sheet which ensures that users do not disturb each other while pulling or pushing the sheet for desired covering. Additionally, there is a long felt need in the art for a modified sheet that provides independent sheets for users. Moreover, there is a long felt need in the art for a modified sheet that remains intact as one sheet until separated. Further, there is a long felt need in the art for a modified sheet that is a single sheet, but can be used independently and simultaneously by two users during sleep. Finally, there is a long felt need in the art for a modified sheet that makes it easier for users to get a good night's sleep and wake up well rested each morning without troubling the other user.

The subject matter disclosed and claimed herein, in one embodiment thereof, comprises a split bedsheet covering. The covering is configured to apply to a mattress and to be used as a covering for users sleeping/laying down on the mattress. The split bedsheet covering comprise a substantially rectangular or square planar sheet that has a top edge, a bottom edge and a pair of side edges. The top edge is positioned near the head panel of the mattress, and the bottom edge is positioned near the foot panel of the mattress. The side edges cover the longitudinal side surfaces of the mattress. The covering has a central split along a central longitudinal axis which is directed from the top edge towards the bottom edge, and is configured to split the bedsheet into a symmetrical right-half portion and a left-half portion. Thus, the right-half and left-half portions can be independently used by two users as per their preferences. Further, the length of the central split is three-fourths of the total length of the bedsheet between the top edge and the bottom edge, thereby allowing a user's feet to be covered by the bedsheet while also allowing users to adjust the remaining sheet.

In this manner, the novel split bedsheet covering of the present invention accomplishes all of the forgoing objectives and provides a relatively easy and convenient solution to allowing users to sleep together with ease, while maintaining a desired sheet coverage and without disturbing the other user. The covering maintains user comfort throughout the night, eliminating the need to constantly adjust blankets and sheets.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a split bedsheet covering configured for application on a mattress, and to be used as a covering for users sleeping/laying down on the mattress. The split bedsheet covering comprises a substantially rectangular or square planar sheet having a top edge, a bottom edge and a pair of side edges. The planar sheet is configured to cover a mattress, wherein the top edge is positioned near a head panel of the mattress, the bottom edge is positioned near a foot panel of the mattress and a central split is positioned along a central longitudinal axis which is directed from the top edge towards the bottom edge. Further, the central split is configured to split the bedsheet into a symmetrical right-half portion and a left-half portion, wherein the right-half portion and the left-half portion are independently used by two users as per their preferences, and the length of the central split is three-fourths of the total length of the bedsheet between the top edge and the bottom edge.

In yet another embodiment of the present invention, the central split is defined by a right split edge of the right-half portion and a left split edge of the left-half portion, and both the right split edge and the left split edge have an interior sewn magnetic strip and padding to increase the weight near the split.

In yet another embodiment of the present invention, the magnetic strips of the right split edge and the left split edge are attached to each other to make the bed covering a single sheet, and can be detached to make two symmetrical half portions for use as two separate coverings.

In yet another embodiment of the present invention, a method of temporarily splitting a planar sheet into two symmetrical portions is described. The method comprises providing a planar sheet having a longitudinal length from a top edge to a bottom edge, wherein the sheet has a central split defined by two split edges having magnetic strips, pulling the magnetic strips apart from each other to create the central split, wherein the central split is of a length at least three-fourths of the longitudinal length of the sheet, creating two separate half portions of the sheet, wherein each half portion is independent along the length of the split, allowing users to utilize the half portions independently as per their needs and/or desires and attaching the split edges after use by fastening the magnetic strips together to form a single sheet.

In a further embodiment of the present invention, the split bedsheet of the present invention allows users sleeping in the same bed to keep their feet covered, and still adjust the remainder of the sheet to their liking. One user can sleep using the first half portion, and the second user can sleep using the second half portion. The sheet maintains comfort for both users throughout the night by eliminating the need to constantly adjust the sheet, thereby ensuring that users receive a good night's sleep and wake up well-rested each morning To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
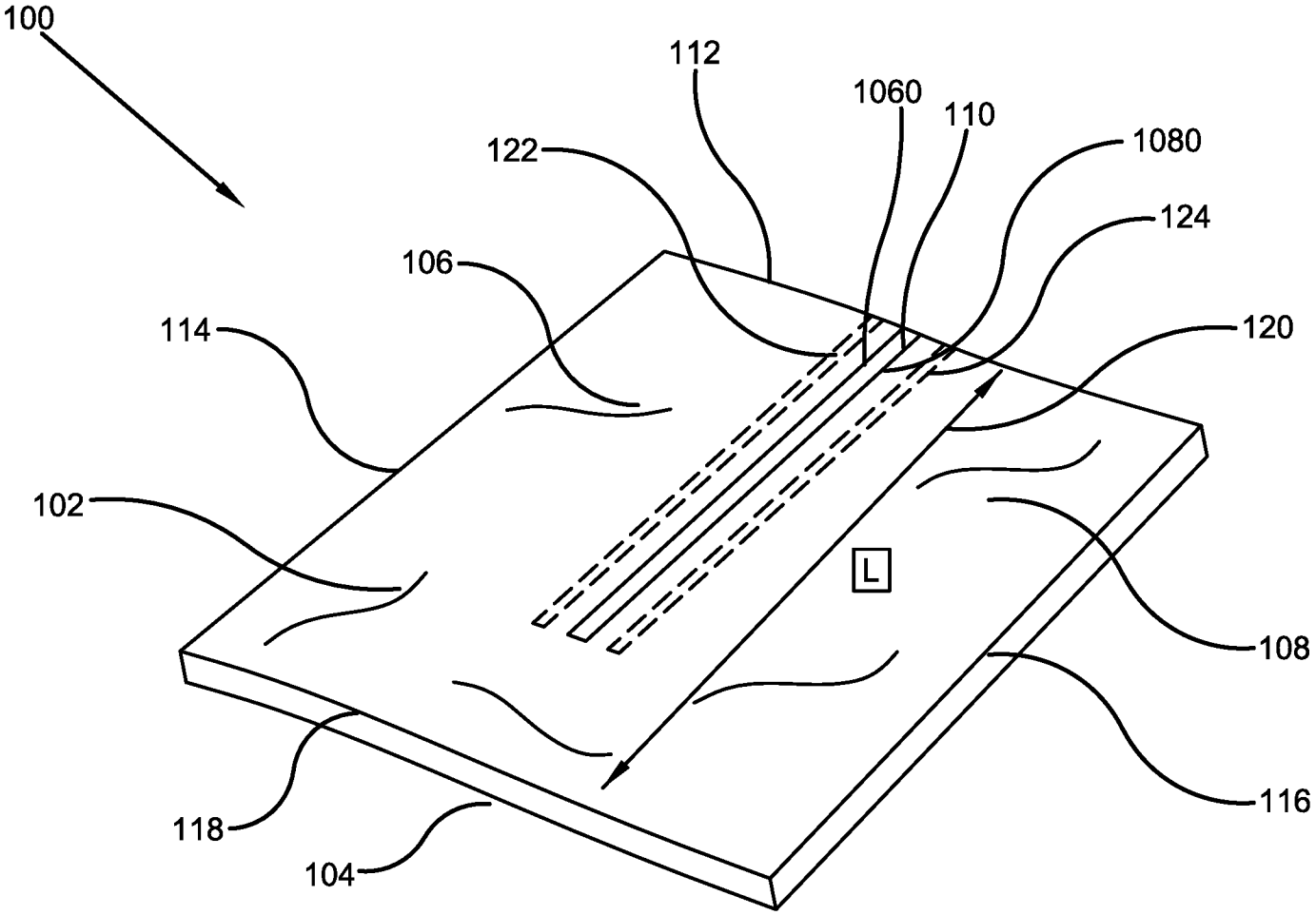
FIG. 1 illustrates a perspective view of one potential embodiment of the split bedsheet covering of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a modified sheet that allows users to maintain a desired coverage throughout the night or any duration when they sleep. There is also a long felt need in the art for a modified sheet which ensures that users do not disturb each other while pulling or pushing the sheet for desired covering. Additionally, there is a long felt need in the art for a modified sheet that provides independent sheets for users. Moreover, there is a long felt need in the art for a modified sheet that remains intact until separated. Further, there is a long felt need in the art for a modified sheet that is a single sheet, but can be used independently and simultaneously by two users/partners. Finally, there is a long felt need in the art for a modified sheet that makes it easier for users to get a good night's sleep and wake up well-rested each morning.

The present invention, in one exemplary embodiment, is a method of temporarily splitting a planar sheet into two symmetrical portions. The method includes providing a planar sheet having a longitudinal length from a top edge to a bottom edge, wherein the sheet has a central split defined by two split edges having magnetic strips, pulling the magnetic strips apart from each other to create the central split, wherein the central split is of a length at least three-fourths of the longitudinal length of the sheet, creating two separate half portions of the sheet by said central split, wherein each half portion is independent along the length of the split, thereby allowing users to use the half portions independently as per their needs and desires, and attaching the split edges after use by fastening the magnetic strips together to form a single sheet.

Referring initially to the drawings, FIG. 1 illustrates a perspective view of one embodiment of the split bedsheet of the present invention. The split bedsheet 100 is a modified bedsheet and is designed to have a split along the middle longitudinal line of the bedsheet 100. More specifically, the bedsheet 100 is a rectangular or square planar sheet manufactured of a fabric such as cotton, polyester, linen, silk, polypropylene, lyocell, bamboo, rayon, etc., or any other suitable material as is known in the art. The bedsheet 100 comprises an upper surface 102 and a bottom surface 104. The split bedsheet 100 also comprises a top edge 112 designed to be oriented towards the head portion of a bed/mattress, where the head of a user lying down on the mattress is positioned. A pair of opposing side edges 114, 116 cover the sides of a mattress on which the bedsheet 100 is used. A bottom edge 118 is designed to be oriented towards the foot portion of the bed/mattress, where the feet of a user lying down on the mattress are positioned.

The split bedsheet 100 has a central split 110 along the longitudinal axis (directed from a top edge 112 towards the bottom edge 118) that splits the bedsheet 100 into two symmetrical portions. The central split 110 splits the bedsheet 100 into a right-half portion 106 and a left-half portion 108 and is defined by a right split edge 1060 and a left split edge 1080. The central split 110 also splits the top edge 112 into two equal lengths, forming the top edges of the right half portion 106 and the left half portion 108. Preferably, the length of the central split 110 is approximately two-thirds of the total longitudinal length "L" 120 of the bedsheet 100. The central split 110 allows the two half portions 106, 108 to be used independently by two users as per their preferences. The right-half portion 106 and the left-half portion 108 are permanently joined to each other near the bottom edge 118 and below the central split 110, thereby allowing users sleeping on the same bed on which the bedsheet 100 is used to keep their feet covered but adjust the remainder of the sheet to their liking.

The central split 110 allows a user to utilize the right-half portion 106 with a second user utilizing the left-half portion 108, while maintaining a desired coverage with each respective portion and without disturbing the other person. The length of the split 110 is less than the total length of the bedsheet and prevents the bedsheet 100 from moving too far to one side and removing the bedsheet 100 from covering another user in the bed. Also, when not in use, the bedsheet 100 is used as a conventional bedsheet to cover the bed and the mattress, and thereby eliminates the need for a separate blanket while sleeping. The bedsheet 100 can also be laid on an existing conventional bedsheet.

Both split edges 1060, 1080 have an interior sewn magnetic strip 122, 124 disposed on each side of the central split 110. The magnetic strips 122, 124 can be fastened to each other, allowing the right portion 106 and the left portion 108 of the bedsheet 100 to attach to each other. This allows the bedsheet 100 to remain intact as one integral sheet until separated by a user for use. As shown, a first magnetic strip 122 is sewn to an interior seam of the right split edge 1060, and a second magnetic strip 124 is sewn to an interior seam of the left split edge 1080, allowing a user to attach the right-half portion 106 and the left-half portion 108 together. When not in use, the bedsheet 100 is installed and snugly fits onto a conventional mattress.

The split bed covering 100 of the present invention is manufactured in a multitude of sizes to accommodate the various mattress sizes, such as twin, full, queen, king, California King, etc. Also, mattress depths, including standard and "pillow top", and various mattress types, such as those used in conventional beds at home, or those used in hotels, hospitals, barracks and other commercial or governmental settings requiring beds can also be accommodated by the split bed covering 100.

Figure 2:
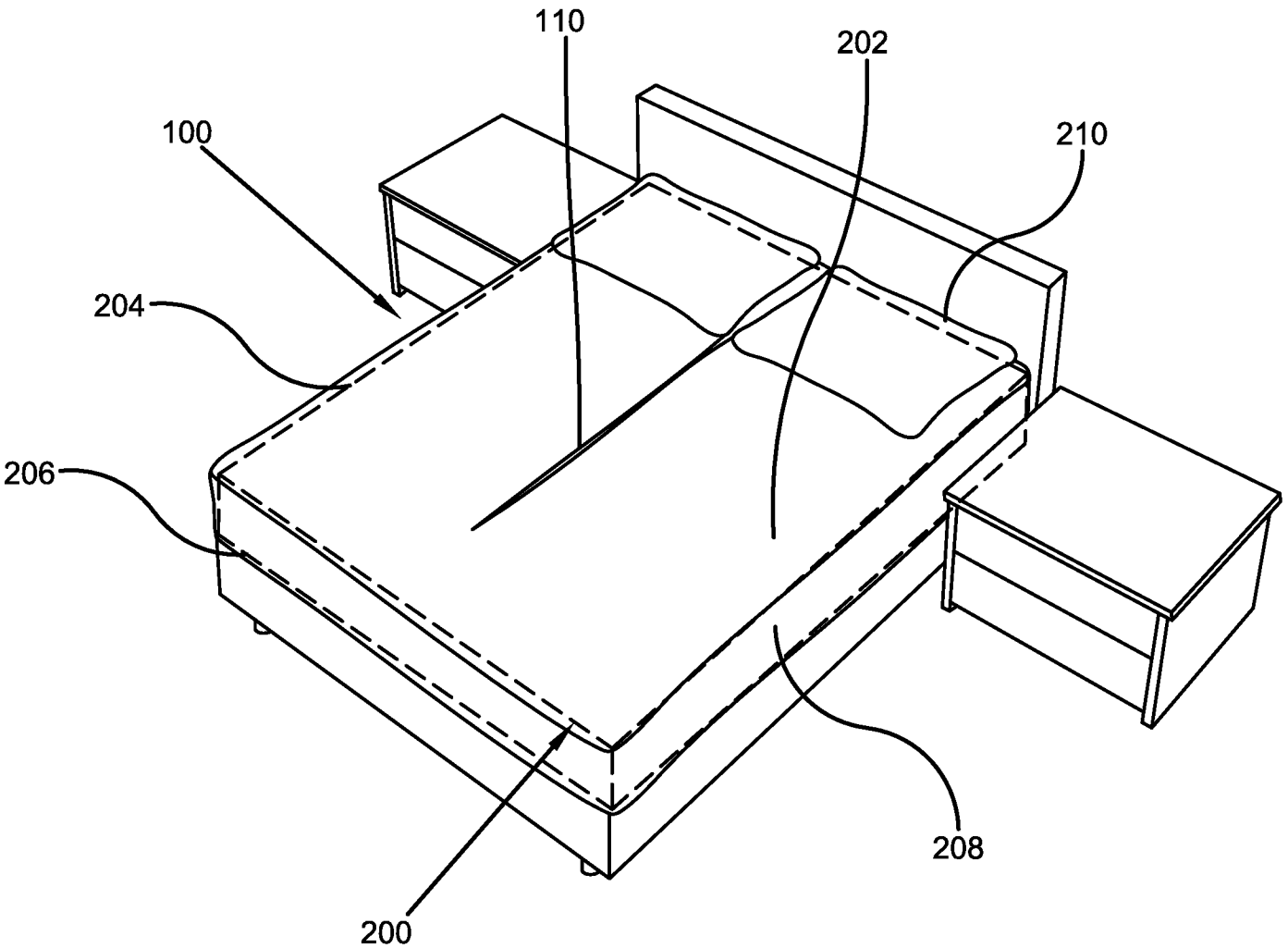
FIG. 2 illustrates a perspective view showing one potential embodiment of the split bedsheet covering of the present invention placed on a mattress in accordance with the disclosed architecture.

FIG. 2 illustrates a perspective view showing the split bedsheet of the present invention placed on a mattress. When the split bedsheet 100 is not in use, the bedsheet 100 is used as a conventional bedsheet to cover a mattress 200. The bedsheet 100 covers the top surface 202, the right longitudinal side surface 204, the transverse foot panel 206, the left longitudinal side surface 208 and the top transverse panel/head panel 210 of the mattress 200. The middle split 110 lies substantially along a virtual central longitudinal axis of the mattress 200, thereby allowing the bedsheet 100 to cover the mattress 200 like a conventional bedsheet. The size of the bedsheet 100 is selected to fit the mattress 200. More specifically, the horizontal cross-sectional shape of the bedsheet 100 generally corresponds to the horizontal cross-sectional shape of the mattress 200. Additionally, the length and width of the bedsheet 100 are equal to, or slightly greater than, the corresponding length and width of the mattress 200.

As stated earlier, when the bedsheet 100 covers the mattress 200, the magnetic strips along the edges of the split 110 are attached to each other to give a smooth look to the bedsheet 100. When the edges of the bedsheet 100 are tucked under the mattress 200, the bed is made properly and provides an aesthetically-pleasing look to the bed.

In one embodiment of the present invention, the bedsheet 100 can be in the form of a quilt, blanket, comforter, duvet-type cover, etc., or any other suitable covering as is known in the art. Further, the bedsheet 100 can comprise a pocket to retain insulating material that can be removed as per the wants and/or needs of a user.

Although not shown, there may be instances where the split bedsheet 100 is only properly-oriented in a single direction. User instructions (not shown) can be provided with the bedsheet 100 so that a consumer knows that the top edge of the bedsheet 100, for example, should only be positioned near the top transverse panel 210 of the mattress 200. User instructions may be provided with the bedsheet 100 regardless of the type of orientation. User instructions may be in the form of written instructions provided with the packaging of the bedsheet 100. For example, a paper insert could contain written instructions.

Figure 3:
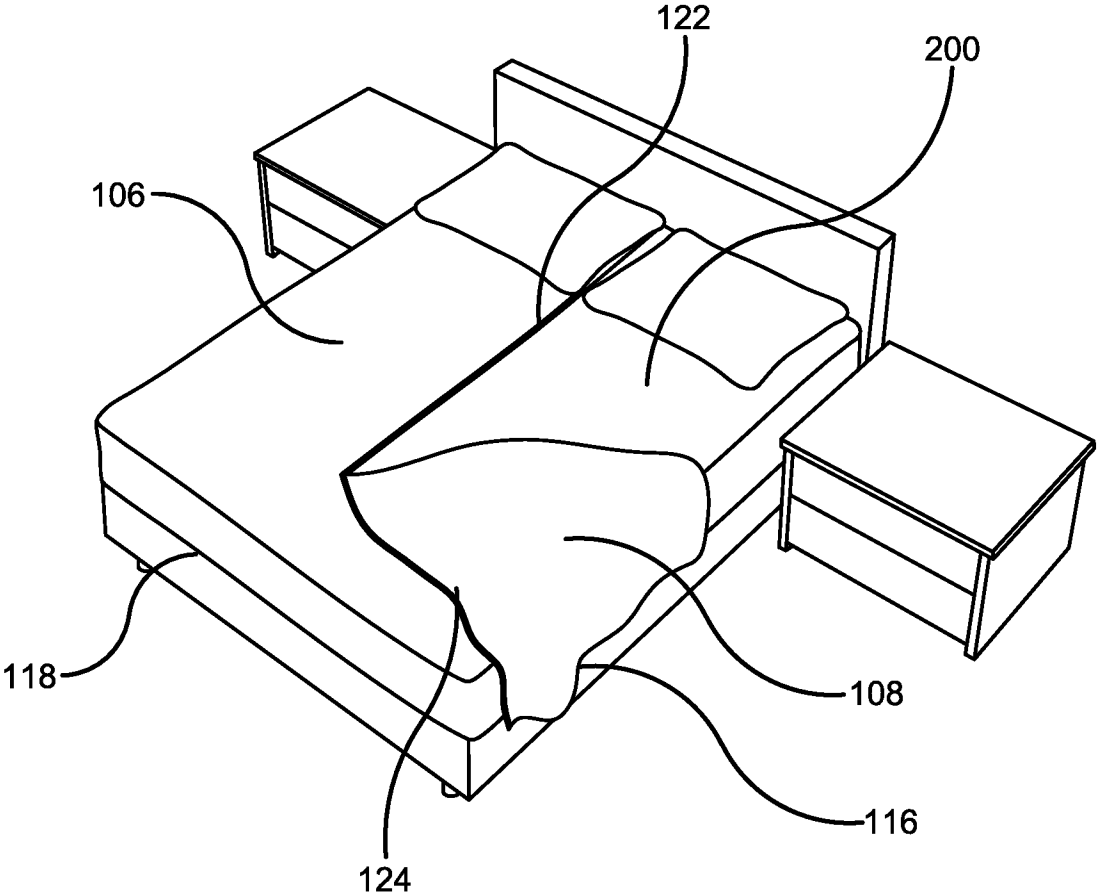
FIG. 3 illustrates a perspective view showing how one potential embodiment of the split bedsheet covering of the present invention splits along the central split in accordance with the disclosed architecture.

FIG. 3 illustrates a perspective view showing how the split bedsheet of the present invention splits along the central split for use. To use a portion (either the right-half portion 106 or the left-half portion 108) as a covering/blanket/quilt, the magnetic strips 122, 124 sewn along the interior seam are unfastened, thereby allowing the right portion 106 and the left portion 108 to be used independently as separate covers. As shown, the left-half portion 108 of the bedsheet 100 is to be used as a cover, while the right-half portion 106 is not wrinkled or disturbed. When another user wants to use the right-half portion 106, the user can use the right portion 106 without disturbing the user that is using the left portion 106.

To split the right-half portion 106 and the left-half portion 108, the magnetic strips 122, 124 are equally pulled apart with minimal force to provide two independent portions 106, 108 that can be adjusted as needed and are connected as a single sheet below the split for providing adequate cover for both users' feet. Further, the interior seams are slightly weighted or padded (shown in FIG. 5 as 502) with additional fabric allowing the sheet to remain intact and not move easily.

Figure 4:
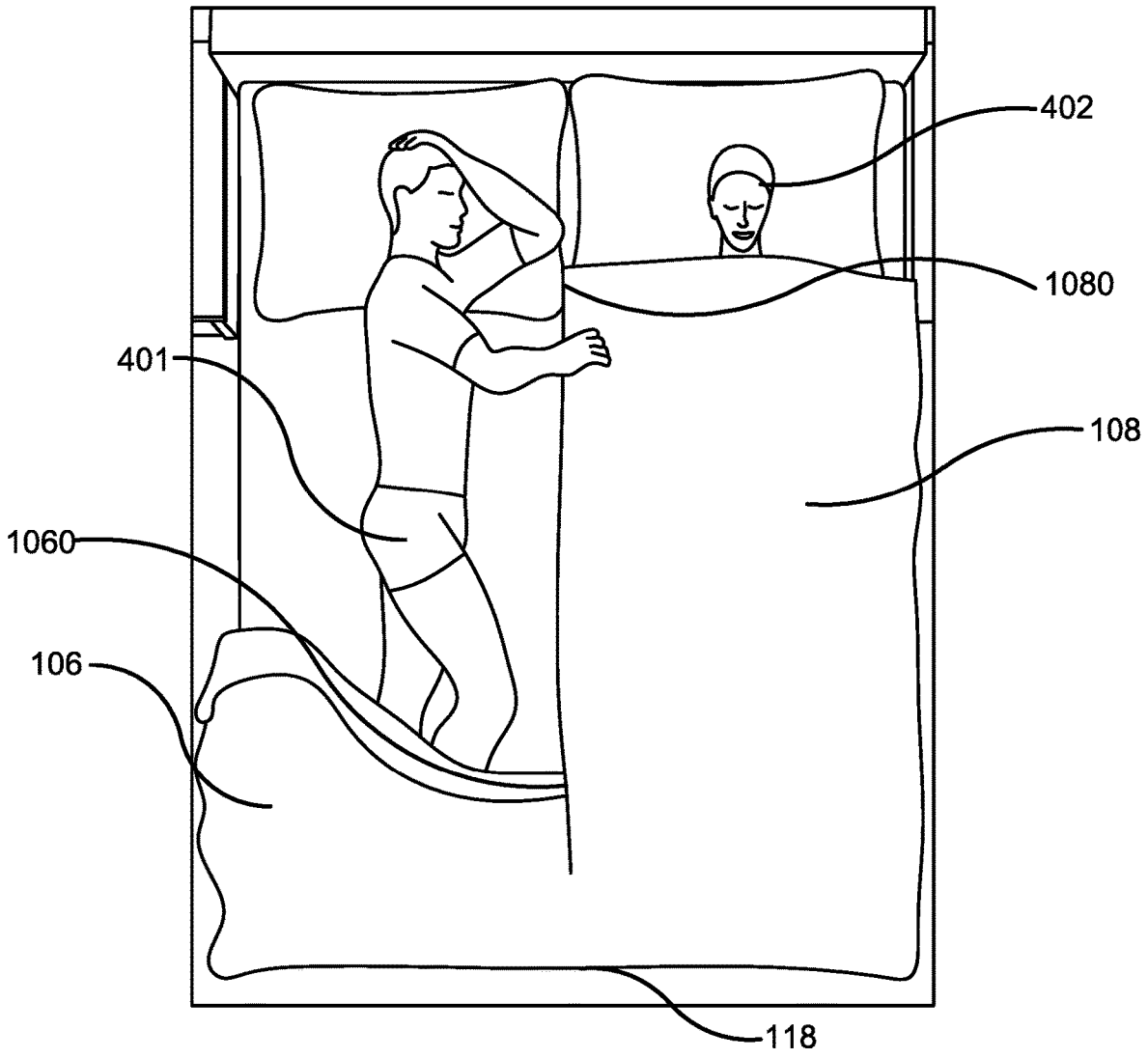
FIG. 4 illustrates a perspective view showing one potential embodiment of the split bedsheet covering of the present invention in use in accordance with the disclosed architecture.

FIG. 4 illustrates a perspective view showing the split bedsheet of the present invention in use. As shown, two users, a first user 401 is using the right-half portion 106 and a second user 402 is using the left-half portion 108 of the split bedsheet. The first user 401 is not covering his or her entire body, but only the feet, whereas the second user 402 is covering his or her whole body using the left-half portion 108 as per his or her preference. As both the right-half portion 106 and the left-half portion 108 are joined near the bottom edge 118 and below the split edges 1060, 1080 and can be adjusted independently of each other along the split edges 1060, 1080, the bedsheet allows the first user 401 and the second user 402 to maintain a desired coverage with their respective portions without disturbing the other user. The split portions 106, 108 maintain comfort for both users 401, 402 throughout the night, thereby eliminating the need to constantly adjust the sheet.

Figure 5:
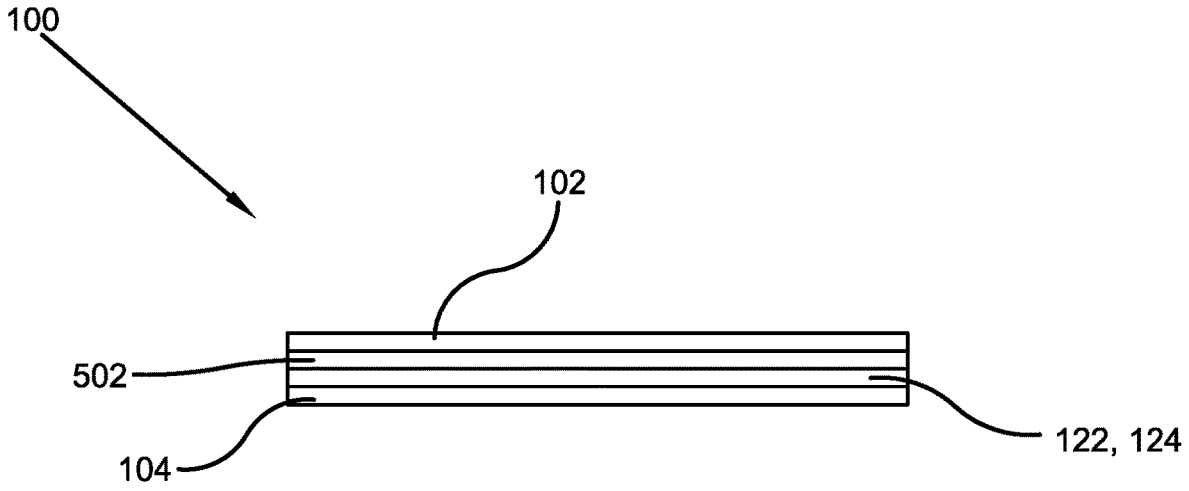
FIG. 5 illustrates a cross-sectional view of the split edges of one potential embodiment of the split bedsheet covering of the present invention in accordance with the disclosed architecture.

FIG. 5 illustrates a cross-sectional view of the split edges of the split bedsheet of the present invention showing the padding and magnetic strip. In order to provide weight and stability near the split of the bedsheet 100, the bedsheet 100 comprises a soft padding 502 and a sewn magnetic strip (either first magnetic strip 122 or the second magnetic strip 124) between the upper surface 102 and the bottom surface 104. Preferably, both the padding 502 and the magnetic strips 122, 124 are sewn to the bottom surface 104, but could be sewn to the upper surface 102 as well. The magnetic strips can be permanently stitched using one or more of a lockstitch, chainstitch, two thread overedge, three thread overedge, four thread overedge, etc., or any other suitable stich as is known in the art.

In use, when splitting the right portion and the left portion of the bedsheet 100 of the present invention, the magnetic strips are detached and each portion can be adjusted independently and as per a user's preferences, while the portion of the bedsheet near the bottom edge 118 is a one-piece unit with the split substantially running three-fourths of the length of the bedsheet 100 and thus, the bottom one-fourth longitudinal length of the bedsheet 100 is planar and permanently attached as a one-piece unit.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "split bedsheet", "bedsheet", and "split bed covering" are interchangeable and refer to the split bedsheet 100 of the present invention.

Notwithstanding the forgoing, the split bedsheet 100 of the present invention can be of any suitable size and configuration as is known in the art without affecting the overall concept of the invention, provided that it accomplishes the above-stated objectives. One of ordinary skill in the art will appreciate that the size, configuration, and material of the split bedsheet 100 as shown in FIGS. 1-5 is for illustrative purposes only, and that many other sizes and shapes of the split bedsheet 100 are well within the scope of the present disclosure. Although the dimensions of the split bedsheet 100 are important design parameters for user convenience, the split bedsheet 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A split bedsheet that provides independent sheets for two users, the split bedsheet comprising:

an upper surface;

a bottom surface;

a top edge;

a pair of opposing side edges;

a bottom edge;

a pair of padding elements; and a central split along a longitudinal axis, wherein the longitudinal axis is directed from the top edge towards the bottom edge to split the split bedsheet into two symmetrical portions, and further wherein the split bedsheet remains intact as one integral sheet until separated by a user for use; and wherein the two symmetrical portions comprise a right half portion and a left half portion;

wherein the right half portion comprises a right split edge and the left hand portion comprises a left split edge;

wherein the right split edge and the left split edge each comprise a magnetic strip chainstitched to the bottom surface between the upper and bottom surfaces;

wherein each padding element is chainstitched to the bottom surface between the upper and bottom surfaces over the respective magnetic strip;

wherein an interior seam of each of the right and left split edges is weighted; and wherein the split bedsheet is a bamboo split bedsheet.

2. The split bedsheet of claim 1, wherein the split bedsheet is a rectangular or square planar sheet.

3. The split bedsheet of claim 2, wherein the top edge is oriented towards a head portion of a mattress.

4. The split bedsheet of claim 3, wherein the bottom edge is oriented towards a foot portion of the mattress.

5. The split bedsheet of claim 4, wherein the pair of opposing side edges cover sides of the mattress.

6. The split bedsheet of claim 1, wherein a length of the central split is two-thirds of total longitudinal length of the split bedsheet.

7. The split bedsheet of claim 6, wherein the right half portion and the left half portion are permanently joined to each other near the bottom edge.

8. The split bedsheet of claim 7, wherein the interior sewn magnetic strip of the right split edge and the left split edge are fastened together allowing the right portion and the left portion to attach to each other.

9. The split bedsheet of claim 1, wherein the split bedsheet is at least one of a bedsheet, a quilt, a blanket, a comforter, or a duvet.

10. A split bedsheet that that provides independent sheets for two users, the split bedsheet comprising:

an upper surface;

a bottom surface;

a top edge;

a pair of opposing side edges;

a bottom edge;

a central split along a longitudinal axis;

wherein the longitudinal axis is directed from the top edge towards the bottom edge to split the split bedsheet into two symmetrical portions;

wherein the two symmetrical portions comprise a right half portion and a left half portion;

wherein the right half portion comprises a right split edge and the left half portion comprises a left split edge;

wherein the right split edge and the left split edge each comprise a magnetic strip and a padding element;

wherein the magnetic strip of the right split edge and the left split edge are fastened together allowing the right portion and the left portion to attach to each other; and wherein the split bedsheet remains intact as one integral sheet until separated via the magnetic strip by a user for use; and wherein each magnetic strip is overedge stitched to the bottom surface between the upper and bottom surfaces and each padding element is overedge stitched to the top surface between the upper and bottom surfaces over the respective magnetic strip;

wherein an insulating material is removably pocketed between the upper and bottom surfaces;

wherein an interior seam of each of the right and left split edges is weighted; and wherein the split bedsheet is a lyocell split bedsheet.

11. The split bedsheet of claim 10, wherein the split bedsheet is a rectangular or square planar sheet.

12. The split bedsheet of claim 10, wherein the split bedsheet is at least one of a bedsheet, a quilt, a blanket, a comforter, or a duvet.

13. A method of temporarily splitting a planar sheet into two symmetrical portions, the method comprising steps of:

providing an instruction for how split the planar sheet into the two symmetrical portions;

providing the planar sheet having a longitudinal length from a top edge to a bottom edge, wherein the planar sheet has a central split defined by two split edges having magnetic strips lockstitched to a bottom surface of the planar sheet between an upper surface and the bottom surface of the planar sheet;

pocketing an insulating material within the planar sheet;

pulling the magnetic strips apart from each other to create the central split, wherein the central split is of a length at least three-fourths of the longitudinal length of the sheet;

creating two separate half portions of the sheet by said central split, wherein each half portion is independent along the length of the split;

allowing users to use the half portions independently; and attaching the split edges after use by fastening the magnetic strips together to form a single sheet.

14. The method of claim 13, wherein the planar sheet is at least one of a bedsheet, a quilt, a blanket, a comforter, or a duvet.

* * * * *